US006918219B1

(12) United States Patent
Olson

(10) Patent No.: US 6,918,219 B1
(45) Date of Patent: Jul. 19, 2005

(54) ROOF VENT HOLE PATCH AND PATCHING METHOD

(76) Inventor: Knute S. Olson, 2715 Eugene Ct., Madison, WI (US) 53711

( * ) Notice: Subject to any disclaimer, the term of this patent is extended or adjusted under 35 U.S.C. 154(b) by 34 days.

(21) Appl. No.: 10/455,763

(22) Filed: Jun. 5, 2003

(51) Int. Cl.[7] ..... E04G 23/00

(52) U.S. Cl. ..... 52/514; 52/58; 52/506.01; 52/746.11; 52/748.1

(58) Field of Search ..... 52/514, 515, 58, 52/61, 62, 506.01, DIG. 12, 741.3, 745.06, 746.11, 748.1; 428/63, 53, 99

(56) References Cited

U.S. PATENT DOCUMENTS

| | | | | |
|---|---|---|---|---|
| 4,947,596 A | | 8/1990 | Kight | |
| 5,005,328 A | | 4/1991 | Holtgreve | |
| 5,269,861 A | * | 12/1993 | Gilbreath | 156/98 |
| 5,687,528 A | * | 11/1997 | Rouch | 52/514 |
| 5,839,241 A | * | 11/1998 | Cacossa et al. | 52/255 |
| 6,162,525 A | * | 12/2000 | Amy | 428/119 |
| 6,293,862 B1 | | 9/2001 | Jafine et al. | |
| 2003/0228438 A1 | * | 12/2003 | Fleck et al. | 428/63 |
| 2004/0045245 A1 | * | 3/2004 | O'Brien | 52/514 |
| 2004/0161572 A1 | * | 8/2004 | Juran et al. | 428/41.8 |

* cited by examiner

*Primary Examiner*—Naoko Slack
*Assistant Examiner*—Jennifer I. Thissell
(74) *Attorney, Agent, or Firm*—Craig A. Fieshcko, Esq.; DeWitt Ross & Stevens S.C.

(57) ABSTRACT

A patch for patching holes in roofs, particularly holes left when roof vents are removed, includes a polymeric tray having extending peripheral flanges and an attachment plug (preferably made of lignocellulosic material such as plywood) depressed within the tray so that its upper surface is flush (or nearly so) with the flanges. The attachment plug (and the portions of the tray floor below it) may be fit into a roof hole, with the flanges resting on surrounding areas of the roof. The flanges may then be affixed to the roof so that the tray forms a supporting web which maintains the attachment plug in the hole. Shingles or other roof coverings may then be fastened to the attachment plug, and to the surrounding flanges and the roof beneath them, so that the hole is patched and the prior presence of the hole is no longer visible.

9 Claims, 1 Drawing Sheet

ROOF VENT HOLE PATCH AND PATCHING METHOD

FIELD OF THE INVENTION

This document concerns an invention relating generally to roofing materials and repair methods, and more specifically to methods and devices for patching roof holes left when roof vents or other structures which extend through a roof are removed.

BACKGROUND OF THE INVENTION

Roofing contractors frequently need to remove structures which extend through roofs, often so that replacement structures may be installed at other locations. As an example, owing to the growing popularity of the use of ridge vents, roofers are frequently asked to remove conventional roof vents—which are generally located somewhere along the slope of the roof between the roof's ridge and the roof edge—and install ridge vents as a replacement. While the installation of the ridge vent is relatively straightforward, removal of the preexisting roof vent can be time-consuming and can cause structural and practical difficulties.

Conventional roof vents generally have an upper hood and/or grille which opens onto a downwardly-extending duct, with the duct defining a square passageway (generally measuring six inches or eight inches square) through the roof into the attic or other space below. When the vent and its duct is removed, the hole left behind in the roof needs to be patched. The patch is then usually covered with a roof covering (e.g., tar paper, shingles, and/or other coverings) for protective and/or decorative purposes.

When performing the patching operation, the roofer cannot simply nail a board over the hole. This would create a raised irregularity in the roof surface with an unattractive appearance, and also would generate potential spots for increased water collection and increased weather wear. While nailing down a sheet metal patch would avoid the problem of an unsightly (and problematic) "bump," this solution generates new problems since heating and cooling causes expansion and contraction of the metal patch, making it difficult for fasteners to strongly maintain the patch in place on the roof. Additionally, sheet metal will provide little underlying support for fasteners when shingles or other roof coverings are later affixed to the patch. Furthermore, sheet metal patches have very poor insulating qualities, and their tendency to heat and cool with the surrounding weather conditions tends to cause rapid aging of any tar paper and/or shingles placed atop them. Thus, most roof covering manufacturers request (and their warranties require) that any shingles or other roof coverings be nailed or otherwise affixed to wood surfaces. Metal patches also generate condensation which may rot away the surrounding roof area. It is therefore strongly preferred in the roofing trade that the vent hole be patched with wood.

Owing to the foregoing problems, the preferred approach in the roofing trade is to cut a strip out of the underlying roof surface, extending horizontally from the vent hole from rafter to rafter, and then nail or otherwise fast a replacement strip (generally made of plywood) to fill in the space left by the vent hole and the surrounding removed portions of the roof. In effect, a section of the roof is replaced. This process is time-consuming and expensive, particularly since the roof covering horizontally bounding the vent hole from rafter to rafter (usually tar paper and shingles) must first be removed; the replacement strip must be cut to the proper size so that it tightly fits within the surrounding roof area; and after the replacement strip is nailed down, its entire area (and the adjacent area) must be reshingled or otherwise covered with the desired roof covering, both for weather protection and so that the patched area does not visibly stand out. Apart from consuming significant time, this process can be dangerous because an appropriately-fit replacement strip is best cut on-site—i.e., on the roof itself, adjacent the hole (so the roofer may view the hole for reference purposes)—and using a saw on the inclined surface of the roof can be dangerous work. The sawdust generated from cutting activities also tends to make the roof surface slippery, which may increase the chance of accident.

The foregoing preferred patching method also suffers from other imperfections apart from its expense, time of installation, and potential danger. In particular, it can cause an "spongy spot" with respect to the surrounding roof, and the replacement strip may bow inwardly or collapse if roofers doing later roof work walk over or otherwise exert pressure on the replacement strip. Additionally, since it can be very difficult to cut a replacement strip which tightly fits within the hole created by the removed roof section, the cracks bounding the replacement strip have an increased possibility for water leakage.

As a result of the foregoing problems, it would be useful to have available new patches and patching methods which at least partially alleviate the installation time, costs, dangers, and other deficiencies of the foregoing patching methods.

DETAILED DESCRIPTION OF PREFERRED VERSIONS OF THE INVENTION

Figure 1:
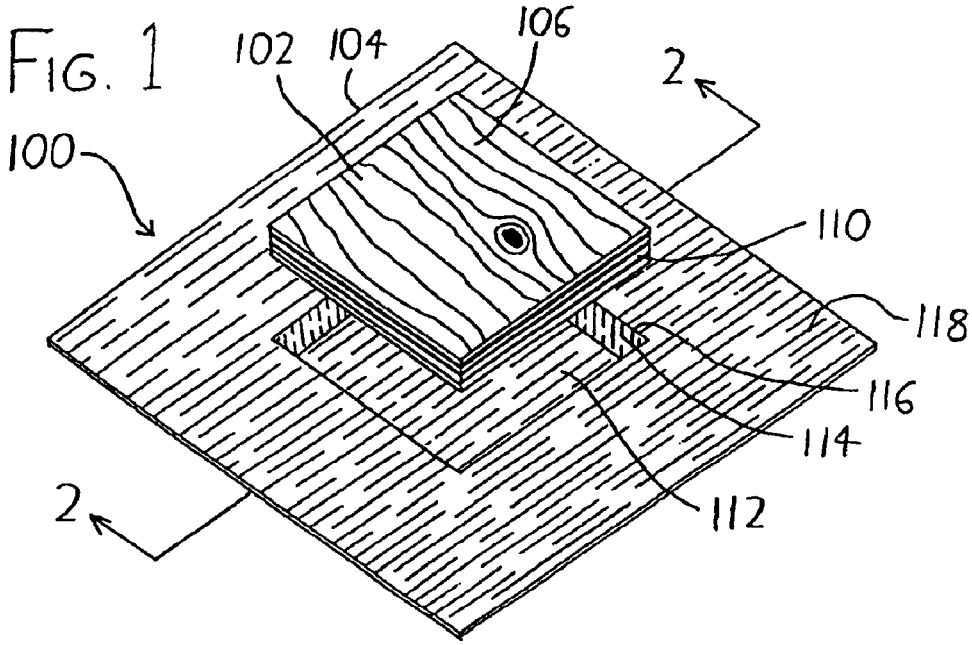
FIG. 1 is an exploded perspective view of a roof hole patch 100 exemplifying the invention.

The invention, which is defined by the claims set forth at the end of this document, is directed to patches and patching methods which at least partially alleviate the aforementioned problems. Looking to FIGS. 1 and 2, an exemplary preferred version of the roof hole patch is designated generally by the reference numeral 100, and has two primary parts: an attachment plug 102 made of rigid material capable of firmly holding any fasteners driven therein, and a tray 104 into which the attachment plug 102 is fit, and which is preferably made of resiliently flexible material into which fasteners may be driven without cracking the tray 104. As will be discussed below with reference to FIG. 3, the patch 100 is to be used to patch a roof vent hole 306 by situating the patch 100 over the hole 306 with the attachment plug 102 (and the immediately adjacent portions of the tray 104) within the hole 306, and with the remainder of the tray 104 resting on the adjacent areas of the roof 300. The portions of the tray 104 resting on the roof 300 may then be fastened to the roof 300, and a roof covering 306 (e.g., tar paper and shingles) may be placed atop the patch 100 on the roof 300, with the roof covering 306 then being fastened to the attachment plug 102. However, prior to further discussion of preferred modes of installing and using the patch 100, it is initially useful to review the structure of the patch 100 in greater detail.

The attachment plug 102 of the patch 100 includes an outer surface 106 which is left exposed on the patch 100, i.e., it is the surface which is preferably left to face outwardly (away from the underside of the roof), to which any roof covering may be attached. An opposing inner surface 108 (not visible in FIG. 1) then faces the interior of a roof hole when the patch 100 is mounted therein. One or more sides 110 extend between the outer surface 106 of the attachment plug 102 and its inner surface 108, and these sides 110 define the thickness of the attachment plug 102. The attachment plug 102 is preferably sized the same as (or similarly to) the sizes of standard ventilation ducts or other structures which are commonly installed within holes in roofs. For example, the attachment plug 102 might have inner and outer surfaces 108 and 106 sized six inches by six inches square, or eight inches by eight inches square, whereby the attachment plugs 102 will readily fit within roof holes formed by the removal of standard roof vents.

The attachment plug 102 is preferably formed of lignocellulosic material, i.e., wood or wood-based material (such as wood composites). The attachment plug 102 should be rigid, and should have sufficient strength that fasteners driven therein, such as fasteners which hold shingles or other roof coverings to the attachment plug 102, will not be easily pulled from the attachment plug 102, even after extended weathering. Thus, materials such as plywood are preferred for use in the attachment plug 102, in contrast to particle board or chipboard, which can degrade over time with exposure to heat and moisture.

In contrast, the tray 104 is preferably formed of polymeric material, i.e., primarily thermoplastic or thermosetting materials. Most preferably, the material for the tray 104 is made of plastic material which does not grow so brittle in cold temperatures that it will shatter or crack when a nail or other fastener is driven therein, and which also does not grow soft and deform when left installed within a hot roof over an extended period of time. A particularly preferred polymeric material is high density polyethylene (RDPE) of the type commonly used for forming gasoline containers (or containers for other volatile organic materials), since these plastics are formulated to be highly stable and durable over a wide variety of temperatures. Chemical stability is desirable since some plastics will degrade over time when exposed to asphalt and/or the organic plasticizers commonly provided in shingles, tar paper, and other roof coverings. Additionally, such plastics usually have low heat conductivity, and therefore they do not generate condensation from the surrounding atmosphere (which may cause damage to surrounding wood of the roof).

Looking to the structure of the tray 104, the tray 104 includes a tray floor 112 whereupon the inner surface 108 of the attachment plug 102 rests, tray walls 114 bounding and extending upwardly from the tray floor 112 to terminate a tray rim 116, and a flange or flanges 118 which preferably extend about the entirety of the tray rim 116 so that the flanges 118 encircle the tray floor 112 and tray walls 114. When the attachment plug 102 is fit within the tray 104, the flanges 118 extend from the sides 110 of the attachment plug 102 in the same plane (or in at least substantially the same plane) as the attachment plug outer surface 106. Additionally, the flanges 118 extend outwardly from the attachment plug 102 by a sufficient distance that several fasteners may be driven through the flanges 118 (and any underlying roof surface) at various locations, if desired.

The flanges 118, and preferably the entirety of the tray 104, are preferably substantially thinner than the attachment plug 102, and most preferably are no greater than approximately 1/16 of an inch thick. This helps to prevent the flanges 118 from defining a visibly raised area on the roof, and additionally portions of thin flanges 118 may be trimmed off by use of a utility knife or other tool if trimming is desired. Thus, a user may trim portions of the flanges 118 entirely off of the tray 104 if desired, so that flanges only extend from a portion of the tray rim 116. Also, by forming the flanges 118 thinly (and by using appropriate polymeric materials), the flanges 118 will preferably be resiliently flexible, that is, they will be bendable by a user to conform to roof surfaces which are not entirely level, but the flanges 118 will nevertheless revert to their original shape if any bending forces are removed.

The patch 100 is preferably provided to a user with the attachment plug 102 firmly affixed within the tray 104, as by applying adhesive to the inner surface 108 of the attachment plug 102 prior to fitting it in the preformed tray 104, or by stapling or otherwise fastening the tray floor 112 to the inner surface 108 of the attachment plug 102. Beneficially, if the tray 104 is formed of thermoplastic material by use of a manufacturing technique such as plug-and-ring forming, it is possible to use the attachment plug 102 as the male plug which is driven into the (softened) plastic blank for the tray 104, and after the attachment plug 102 is driven into the blank to form the tray 104, the tray 104 can be left to cool, contract, and set about the attachment plug 102 to firmly maintain it within the tray 104.

The tray 104 is preferably integrally formed, i.e., the tray floor 104, tray walls 114, and flanges 118 are preferably all molded from a continuous piece of polymeric material. This ensures that the flanges 118 and any intermediate portions of the tray floor 104 form a sturdy bridge across any roof hole covered by the patch 100. Since the flanges 118 function as the attachment point between the patch 100 and the roof, and the tray floor 112 (and to some degree the tray walls 114) serves as a web to support the attachment plug 102 within the hole, the attachment plug 102 will be maintained within the roof hole without any need for direct affixation between the attachment plug 102 and the surrounding roof surface.

Figure 2:
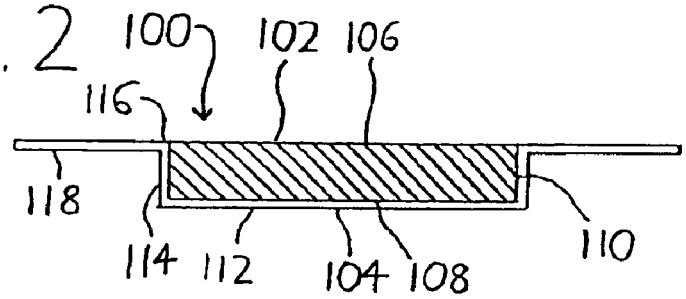
FIG. 2 is an elevated cross-sectional view of the roof hole patch 100 of FIG. 1, as viewed from the line 2—2 in FIG. 1 (after assembly of the patch 100).

Usefully, all or a portion of the tray 104 may be colored, as by addition of the appropriate colorants to the polymers used to form the tray 104, so that the tray floor 112 will contrast with the appearance of the surrounding wood of the roof. Thus, for example, when a home inspector or roofer views the underside of the roof during an attic/roof inspection, the tray floor 104 will be readily visible to illustrate where the former hole in the roof was situated. Preferred colors for the tray 104 are bright yellow or orange, which are plainly visible when situated next to the plywood that is generally used for roofs, and additionally such colors allow easy visibility of notes written on the tray floor 112 by markers or the like (for example, when a roofer writes the date of installation on the tray floor 112 so that it will be visible from the underside of the roof during later inspection). An alternative is to color at least the tray floor 112 with a reflective metallic finish (e.g., with an adhesive foil) so that it will readily stand out when exposed to a flashlight or another illumination source. Additionally, as depicted in FIG. 1, the surface of the tray 104 can beneficially be roughened or striated during the molding process so that it bears a non-skid surface, which can be useful when working on a sloped roof.

Figure 3:
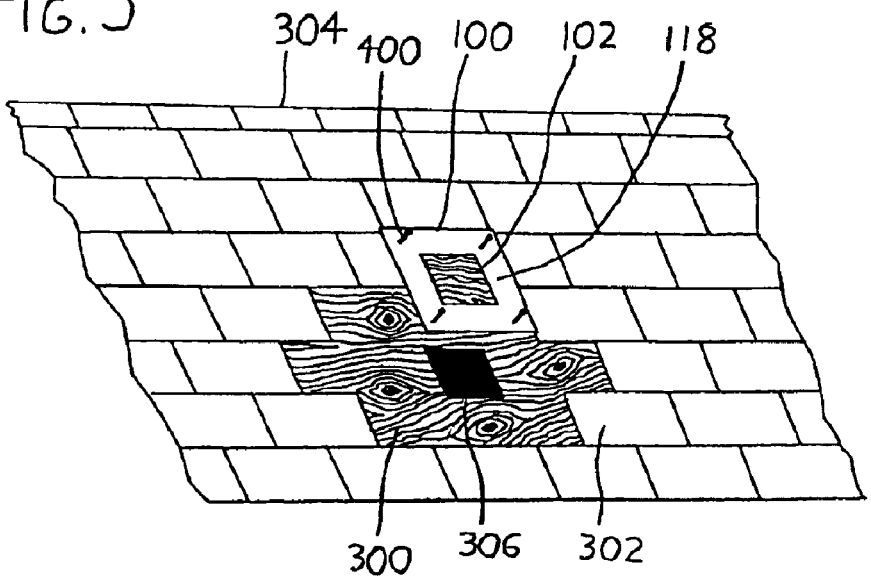
FIG. 3 is a view of a section of a roof 300 shown with a vent hole 306 remaining after removal of a vent, and with the shingles 302 surrounding the vent hole 306 removed, and showing the roof patch 100 of FIGS. 1 and 2 above the roof 300 in a location shortly prior to its placement within the hole 306.

Referring then to FIG. 3, a portion of a roof is shown with a plywood roof surface 300 (plywood being the most common material used for roof surfaces), and an overlaying roof covering 302, here depicted as shingles (with any roof felt/tar paper underlying the shingles 302 not being depicted). The ridge of the roof is shown at 304, and a vent hole 306, formed by removal of a vent from the roof surface 300, is shown with the surrounding roof covering 302 removed (with such removal being a standard step after a roof vent is removed and patching is to be performed). Rather than patching the hole 306 with sheet metal and shingling over it, or cutting horizontally outwardly from the vent hole 306 between rafters and then installing (and shingling over) a replacement strip, a roofer may instead take the patch 100 install it on the roof by inserting the attachment plug 102 within the vent hole 306, with the flanges 118 resting on the roof surface 300 surrounding the vent hole 306. Since the attachment plug 102 may be formed in a variety of sizes and shapes corresponding to those of common vent ducts, the user may simply choose a patch 100 having an attachment plug 102 appropriately sized to have its sides 110 closely fit about the perimeter of the hole 306. One or more fasteners 400 may then be driven into the flanges 118 and into the roof surface 300 below, thereby securing the attachment plug 102 within the hole 306. A roof covering (e.g., tar paper and replacement shingles) may then be placed atop the attachment plug 102 and its flanges 118 to restore the roof surface 300 to its finished "ventless" appearance. The replacement roof covering may be fastened down with fasteners, with such fasteners easily being able to pierce the flanges 118 and affix to the roof surface 300, and additionally being readily able to pierce and affix to the attachment plug 102.

As a result of the foregoing arrangement, the patch 100 provides numerous useful advantages. It allows a roof hole to be plugged from the exterior (the top) of the roof without any need to remove adjacent sections of roof surface, and with no need to travel between the top of the roof and its underside (e.g., within an attic) to effect patching. The patch 100 provides material within the hole for receiving fasteners, at a height flush (or substantially flush) with adjacent areas of the roof surface, to allow shingles or other roof coverings to be fastened down at the same height as adjacent shingles attached directly to the roof surface. Installation may be performed very rapidly with standard fasteners, and no time-consuming installation steps are needed (such as preliminary cutting and fitting steps, as with the aforementioned replacement strips). Additionally, with proper choice of materials, the patch 100 may provide excellent durability and a long lifespan.

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Initially, while the attachment plug 102 is depicted with a square configuration, having four sides 110 of equal length, it should be understood that the attachment plug 102 may have any number of sides having the same or different lengths to allow patching of roof vent holes of various configurations. However, since it is expected that the patch 100 will be manufactured in a number of stock sizes to fit holes left by more common vent designs, square and perhaps circular attachment plugs 102 would probably be most beneficial.

Further, the tray 104 need not be formed with flanges 118 extending about the entirety of the tray rim 116. As an example, the tray 104 could be formed with the flanges 118 only extending from selected sides 110 of the attachment plug 102. Preferably, the flanges 118 at least extend from opposing sides of the attachment plug 102 so that opposing sides of the tray 104 may be firmly affixed to a roof surface across a hole.

Additionally, just as it is not necessary to provide flanges 118 about all sides of the attachment plug 102, it is also not necessary to have the tray floor 104 extend across the entirety of the inner surface 108 of the attachment plug 102. For example, the tray floor 104 might be provided as strips or a grid of material extending between the flanges 118.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A roof hole patch comprising:

a. an attachment plug formed of rigid lignocellulosic material, the attachment plug having an outer surface, an opposing inner surface, and one or more sides extending therebetween;

b. flanges formed of polymeric material, the flanges protruding from the sides of the attachment plug at or about the plane of the outer surface of the attachment plug; and c. a web connecting the flanges and being integrally formed therewith, the web extending at least partially across the inner surface of the attachment plug, wherein the roof hole patch is fit within a hole in a roof and:

a. the attachment plug is inserted into the hole with the sides of the attachment plug closely fit about the hole's perimeter, b. the flanges rest on the roof surrounding the hole and are attached to the roof by fasteners.

2. The roof hole patch of claim 1 wherein the web defines a tray wherein the attachment plug is fit, and wherein the flanges define at least a portion of the rim of the tray.

3. The roof hole patch of claim 2 wherein the attachment plug is maintained within the tray by at least one of:

a. adhesive, and b. one or more fasteners.

4. The roof hole patch of claim 1 wherein the flanges are resiliently flexible, whereby they are bendable but return to their original orientation when bending forces are removed.

5. The roof hole patch of claim 1 wherein the flanges are no greater than 1/16 inch thick.

6. The roof hole patch of claim 1 wherein a roof covering is situated atop the roof, the attachment plug, and the flanges, and is affixed to the attachment plug by one or more fasteners.

7. A method of patching a hole in a roof comprising:

a. providing a roof patch including:

i. an attachment plug having an outer surface, an opposing inner surface, and one or more sides extending therebetween, the attachment plug:

(1) having a thickness defined between the outer and inner surfaces, and (2) being formed of rigid material which firmly engages a fastener driven therein;

ii. one or more flanges extending from the sides of the attachment plug at or at least substantially about the plane of the outer surface, the flanges:

(1) having a thickness substantially less than the thickness of the attachment plug, and (2) being formed of resiliently flexible material which firmly engages a fastener driven therein;

b. inserting the attachment plug into the hole with the sides of the attachment plug closely fit about the hole's perimeter, and with the flanges resting on the roof surrounding the hole;

c. driving one or more fasteners into the flanges and the roof below, thereby securing the attachment plug in the hole; and d. placing a roof covering atop the attachment plug and flanges.

8. The method of claim 7 further comprising the step of driving one or more fasteners through the roof covering and into the attachment plug.

9. The method of claim 7 further comprising the initial step of removing a vent from the roof to define the hole wherein the attachment plug is inserted.

* * * * *